United States Patent [19]

Mulinix

[11] 4,050,175

[45] Sept. 27, 1977

[54] LOADING DEVICES FOR MUZZLE LOADING RIFLES

[76] Inventor: Lavern F. Mulinix, 445 W. High St., Alliance, Ohio 44460

[21] Appl. No.: 722,025

[22] Filed: Sept. 10, 1976

[51] Int. Cl.[2] ..... F41C 27/00

[52] U.S. Cl. ..... 42/90

[58] Field of Search ..... 42/90; 86/33; 206/3

[56] References Cited

U.S. PATENT DOCUMENTS

| | | | |
|---|---|---|---|
| 163,404 | 5/1875 | Phillips | 42/90 |
| 184,079 | 11/1876 | Hovis | 42/90 |
| 243,250 | 6/1881 | Hall | 86/33 |
| 2,451,015 | 10/1948 | Adams | 206/3 |
| 3,747,252 | 7/1973 | Walker | 42/90 |

*Primary Examiner*—Charles T. Jordan
*Attorney, Agent, or Firm*—Michael Williams

[57] ABSTRACT

My invention provides a fully loaded device which is carried by a hunter in an easily accessible position for quick re-loading of a muzzle loading rifle.

The device comprises a tubular member and removable end caps on opposite ends of the member. Removal of one end cap permits a patch and ball shot to be inserted into the open end of the tubular member. Replacement of such one end cap and removal of the other end permits powder to be poured into this open end of the tubular member. After replacement of said other end cap, the fully loaded device is adapted to be suspended by a neck sling.

In order to quickly fire a second shot, the hunter grasps the tubular member with one hand and pulls downwardly thereon. This causes disengagement of said first end cap so that in the same motion the open end of the tubular member may be positioned over the end of the rifle barrel and in alignment with the barrel bore. Thereafter, a plunger is operated to push the patch and ball into the barrel bore.

9 Claims, 7 Drawing Figures

LOADING DEVICES FOR MUZZLE LOADING RIFLES

BACKGROUND AND SUMMARY

Prior art known to me is represented in the following patents: U.S. Pat. Nos. 163,404, Phillips, May 18, 1875; 184,079, Hovis, Nov. 7, 1876; 3,747,252, Walker, July 24, 1973.

The early prior art, as shown in the Phillips and Hovis patents, related to revolvable chambers, much like that used in the ordinary hand gun. These required a cap-piece which was adapted to fit over the end of the rifle barrel, and means to align a chamber with the barrel bore. The later patent to Walker relates to a tool for lining up and piloting a ball shot into the rifle muzzle. The known prior art devices did not provide a readily accessible loading device, and insofar as applicant is aware, are not widely used because of this.

In contrast, my improved device may be loaded with a patch, ball, and powder and, since it is suspended by a neck sling, it is immediately accessible for use. To quickly load the rifle for a second shot, the hunter merely pulls on a tubular member forming part of my improved device. This pull releases the member from one end cap so that the grasped member may be inverted and aligned with the rifle barrel bore, whereby the powder flows into the bore and the patch and ball are started on their way into the bore by a plunger carried by the tubular member.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

Figure 1:
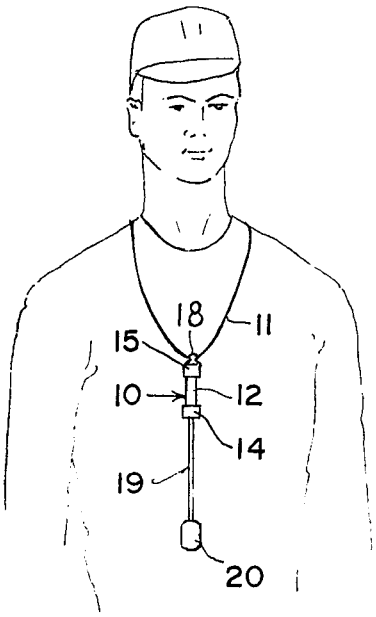
FIG. 1 shows my improved device as normally worn by a hunter or other rifle user, in readily accessible position.

My improved loading device 10 is adapted to be supported from the neck of a person by a suitable sling 11, as seen in FIG. 1. In this position, it dangles in the chest area of a user and is immediately accessible for use.

Figure 2:
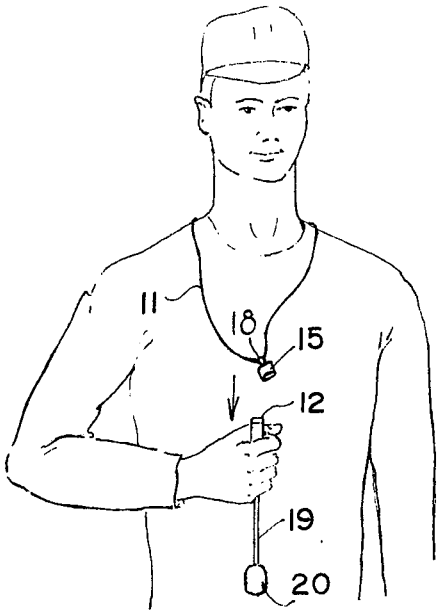
FIG. 2 is a view similar to FIG. 1, but showing the condition of parts just after the hunter has exerted a pull on the tubular member of my device.
Figure 3:
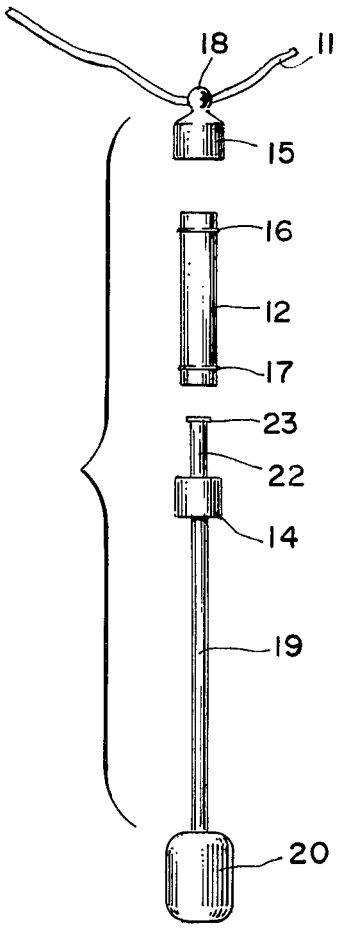
FIG. 3 is a small scale elevational view of parts of my device in separated relation.

The loading device 10 comprises a tubular member 12 which may be formed of any rigid material, such as a suitable metal or plastic. An end cap 14 is removably connected to one end of the tubular member and a second end cap 15 is removably connected to the opposite end of the member. At least the connection between the tubular member 12 and the end cap 15 should be such that disconnection may be effected by a separating pull. For this purpose I have found it suitable to utilize a split metal ring 16 seated in an annular groove in the tubular member 12, but projecting from the external surface of the latter sufficiently to snap into an annular groove on the interior surface of the end cap 15. The end cap 14 may have a different type of connection with the member 12, such as screw threads, bayonet connection, or the like, but for simplicity of manufacture, this connection may also be in the form of a split ring 17, similar to that just described. In some cases, it is desirable to make the split ring connection 17 more resistant to separation than that of the ring connection 16, to insure that a pull on the tubular member 12, as shown in FIG. 2, will always cause separation of the connection 16.

The end cap 15 is provided with an apertured head 18 so that the neck sling 11 may be connected thereto. The sling may take any suitable form and preferably is flexible, such as a leather thong as herein shown, which may have its ends knotted together to form a loop which will freely pass over the head of a person.

Slidable axially within an opening in the end cap 14 is a plunger 19 which is presently in the form of an elongated round rod of any suitable rigid material, such as metal, wood or plastic. The rod preferably has an enlargement 20 on its outer end for hand-grip purpose. The inner end of the rod has an undercut portion 21 over which a ferrule 22 is pressed and firmly held in position. The ferrule has a headed extremity 23 to prevent complete withdrawal of the rod from the end cap 14, and the extremity 23 has a circular concavity 24 to receive a peripheral part of a ball shot 25.

Figure 4:
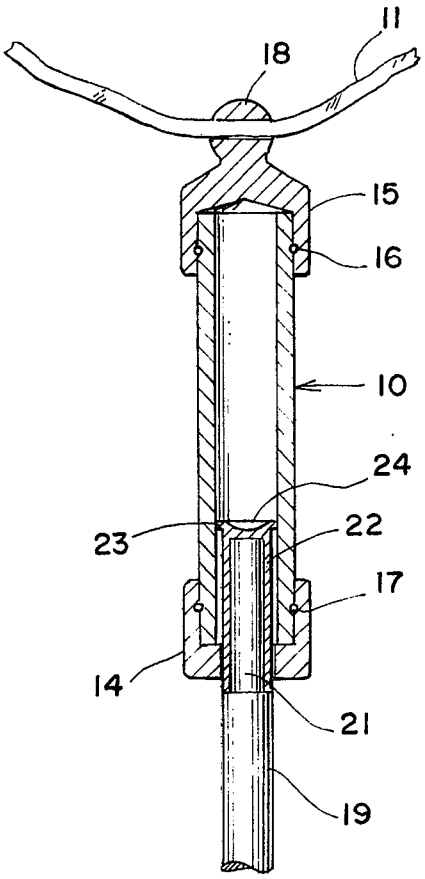
FIG. 4 is an enlarged, fragmentary sectional view of my loading device, in empty condition.

The loading device is shown in empty condition in FIG. 4, and may be loaded during the leisure time of a hunter, and when the device is not suspended from the hunter's neck. To load the device, the end cap 14 is removed, and this may be effected by grasping the tubular member 12 in one hand and pulling on the rod 19 or end cap with the other.

Figure 5:
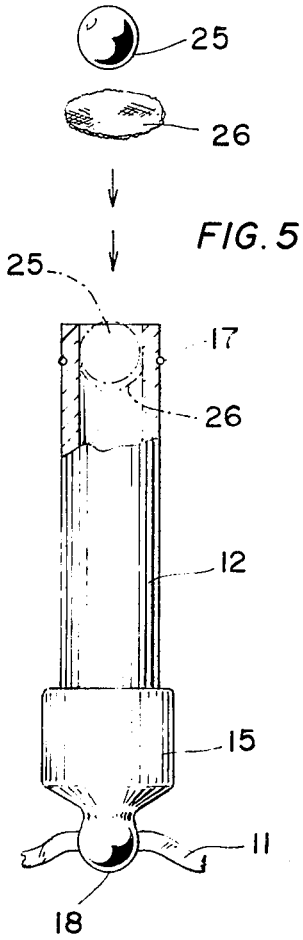
FIG. 5 is an elevational view, partly in section, showing the tubular member in condition for loading a lubricated patch and ball shot therein.
Figure 7:
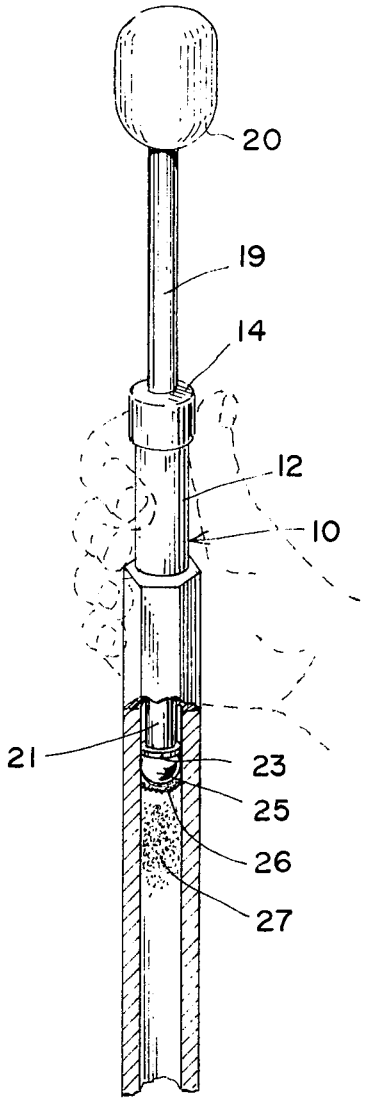
FIG. 7 shows my improved loading device in position on the rifle barrel, with the powder, patch and ball part-way to final position in the rifle bore.
Figure 6:
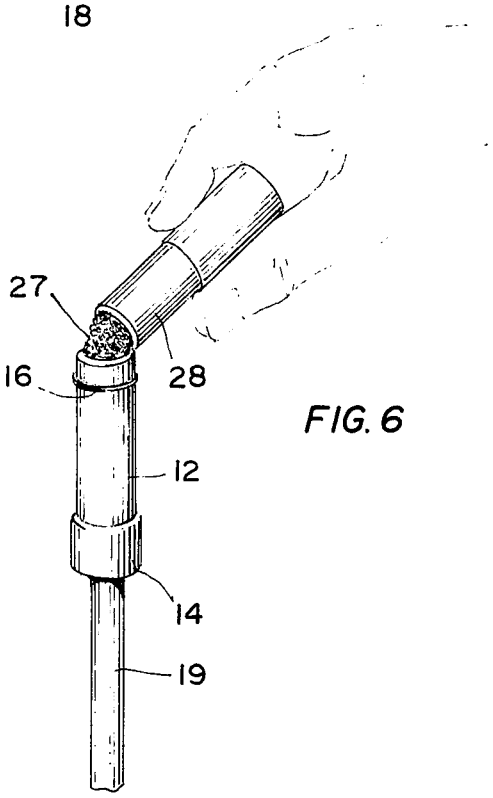
FIG. 6 shows a following step wherein the gun powder is being loaded into the tubular member.

A lubricated patch 26 and the ball 25 are placed on the open end of the tubular member 12 and pushed by finger pressure into the member to the position shown in dot-dash lines in FIG. 5. The end cap 14 is then replaced, the tubular member 12 is inverted, and the end cap 15 is removed, as seen in FIG. 6, so that gun powder 27 may be poured into the open end of the tubular member in any desired amount, as measured in a commercially available powder measure 28. The end cap 15 is then replaced and loading of the device has been completed. The sling 11 is placed over the hunter's head so as to support the device 10 in the position shown in FIG. 1.

After the hunter has fired the single shot already in the rifle, he may quickly reload the rifle for a second shot in the following manner: First he grasps the tubular member 12 in one hand and may hold the rifle in the other hand with the muzzle pointing upwardly. He then pulls downwardly on the member 12 and this separates the latter from the end cap 15 which remains suspended from the neck sling. In the same motion, the hunter may invert the tubular member 12 and place it in abutting relation over the end of the rifle barrel, using the same hand to hold the tubular member and the upper end of the rifle barrel, with the tubular member aligned. Then with the other hand, which no longer is needed to support or steady the rifle, the hunter pushes down on the plunger 19 to move the patch 26 and ball 25 on their way into the barrel bore, the powder 27 having already gravitated toward the closed lower end of the barrel bore. The loading device is then removed from the rifle and the usual ram rod (not shown) is used to move the patch and ball downward to final position wherein the two seat on the powder and compress the same.

I claim:

1. A loading device for a muzzle-loading rifle, comprising:

a tubular holder, adapted to contain gun powder and a ball shot, an end cap for closing an end of said holder to contain the gun powder and ball therein, said end cap having a connection with said holder that may be broken by a pulling force applied in an axial direction on one of said end cap and holder while holding the other stationary to separate said end cap from said holder, whereby to provide for transferal of said gun powder and ball from said holder through the opening of the barrel bore of said rifle and into said bore.

2. The construction according to claim 1 wherein a sling is connected to said end cap, said sling being adapted to be worn about a part of a person's body, such as the neck part, and wherein said connection is broken by a pulling force applied to said tubular holder.

3. A loading device for a muzzle-loading rifle, comprising:

a tubular holder, adapted to contain gun powder and a ball shot, closures at opposite ends of said holder for containing the gun powder and ball therein, one of said closures being in the form of an end cap having connection with said holder that may be broken by a pulling force applied in an axial direction on one of said one end cap and said holder while holding the other stationary, whereby to provide for transferal of said gun powder and ball from said tubular holder through the opening of the barrel bore of said rifle, and plunger means slidably supported by the other end closure for ejecting said ball from said tubular holder.

4. The construction according to claim 3 wherein a sling is connected to said end cap, said sling being adapted to be worn about a part of a person's body, such as the neck part, and wherein said connection is broken by a pulling force applied to said tubular holder.

5. The construction according to claim 3 wherein both said closures are in the form of end caps, each having a connection that may be broken by a said pulling force.

6. The construction according to claim 5 wherein the connection between each end cap and said tubular holder is in the form of a split ring seated in an annular groove in an end cap and adapted to have snap fit in an annular groove in a respective end of said tubular holder.

7. The method of loading a device for use with a muzzle-loading rifle, said device comprising a tubular member and removable end caps closing opposite ends of the same, one of said end caps having a connection with said tubular member that may be easily broken by applying a pulling force in an axial direction on one of said one end cap and said tubular member while holding the other stationary to separate said one end cap from said tubular member, said method comprising:

removing the other end cap from its end of said tubular member to open such end, and inserting a ball shot into said tubular member through such end, replacing said other end cap and inverting said tubular member, applying a pulling force to remove said one end cap from the opposite end of said tubular member to open said opposite end, and pouring a predetermined amount of powder into said tubular member through said opposite end, and then replacing said one end cap in position to close said opposite end of said tubular member.

8. The method of claim 10 wherein a lubricated patch is also loaded into said tubular member, including the step of positioning said patch over the opening into said tubular holder when said one cap is removed and utilizing said ball to press said patch into said holder.

9. The method of quick loading a muzzle-loading rifle through use of a loading device including a tubular holder and an end cap closing one end of said holder and confining gun powder and a ball shot therein, said end cap being removable from said tubular member by a pulling force and being attached to a sling worn about the neck of a person so that it and said tubular holder dangle from said sling in the chest area of a person, said method comprising:

grasping said tubular holder in one hand while holding the rifle upright with the other, and pulling on said tubular holder to remove it from said end cap, and while still so grasping said tubular holder positioning the now open end thereof against the end of the rifle barrel and in alignment with the opening into its bore so that the gun powder pours into the barrel bore, and pushing said ball from said tubular holder into the barrel bore.

* * * * *